US007675243B2

(12) United States Patent
Hsu et al.

(10) Patent No.: US 7,675,243 B2
(45) Date of Patent: Mar. 9, 2010

(54) TWO-END DRIVEN LAMP CONTROLLING DEVICE

(75) Inventors: Cheng-Chia Hsu, Chupei (TW); Teng-Kang Chang, Jhudong Township, Hsinchu County (TW); Yun-Ching Wu, Hsinchu (TW); Yu-Cheng Pan, Houlong Township, Miaoli County (TW)

(73) Assignee: Logah Technology Corp., Hsinchu (TW)

( * ) Notice: Subject to any disclaimer, the term of this patent is extended or adjusted under 35 U.S.C. 154(b) by 350 days.

(21) Appl. No.: 11/938,859

(22) Filed: Nov. 13, 2007

(65) Prior Publication Data

US 2008/0116824 A1 May 22, 2008

(30) Foreign Application Priority Data

Nov. 17, 2006 (TW) ..... 95220244 U

(51) Int. Cl.
*H05B 41/24* (2006.01)

(52) U.S. Cl. ..... 315/277; 315/294; 315/291; 315/312; 315/276; 315/246

(58) Field of Classification Search ..... 315/276, 315/277, 279, 291, 294, 307, 312, 246, 220, 315/212, 209 R; 345/102
See application file for complete search history.

(56) References Cited

U.S. PATENT DOCUMENTS 7,126,289 B2 * 10/2006 Lin et al. ..... 315/308
7,205,726 B2 * 4/2007 Maeda et al. ..... 315/277
7,477,022 B2 * 1/2009 Wi et al. ..... 315/291
2005/0225514 A1 * 10/2005 Ahn et al. ..... 315/169.3
2006/0284575 A1 * 12/2006 Shen et al. ..... 315/312

* cited by examiner

*Primary Examiner*—Douglas W Owens
*Assistant Examiner*—Ephrem Alemu
(74) *Attorney, Agent, or Firm*—Chun-Ming Shih

(57) ABSTRACT

A two-end driven lamp controlling device includes a direct-current (DC) power supply, square wave switches, a square wave controller, a plurality of lamps, a plurality of starting transformers and a plurality of lamps commonly connective transformers, wherein the plurality of starting transformers or the plurality of lamps commonly connective transformers are disposed besides the plurality of lamps and the square wave switches are connected to the sides of the plurality of starting transformers or the plurality of lamps commonly connective transformers and to the DC power supply and can receive signals from the square wave controller. The present invention utilizes a circuitry design of a plurality of lamps, a plurality of starting transformers and a plurality of lamps commonly connective transformers so as to make the brightness of the plurality of lamps effectively homogenized and balanced and, moreover, to solve the problem of high cost for conventional devices, which use too many components for maintaining the brightness of the lamps.

5 Claims, 8 Drawing Sheets

TWO-END DRIVEN LAMP CONTROLLING DEVICE

This application claims the benefit of Taiwan patent application No. 095220244, filed on Nov. 17, 2006.

BACKGROUND OF THE INVENTION

1. Field of the Invention

The present invention relates to a two-end driven lamp controlling device and, in particular, to a two-end driven lamp controlling device for balancing the brightness of a liquid crystal display (LCD) backlight.

2. Descriptions of the Related Art

Refer to FIG. 1, which is a block diagram of a conventional two-end driven lamp controlling device. As shown, the conventional two-end driven lamp controlling device 1 has a DC power supply 12 disposed on one side of a plurality of lamps 11, the DC power supply 12 is used for supplying DC power to a square wave switch 13, the square wave switch 13 is used for receiving synchronous control signals input from a square wave controller 14 and providing starting transformers 15 with square wave signals and the starting transformers 15 is used for outputting signals such as to drive the lamps 11 in coordination with a plurality of capacitive elements 16, so that the purpose for maintaining a homogenized brightness of the lamps 11 can be fulfilled. According to the block diagram shown in FIG. 1, there should be capacitors disposed at both ends of the lamp, for providing the lamp with sufficiently high voltage to keep the brightness from being inhomogeneous. However, the use of high voltage may cause a problem of voltage endurance, which would be hard to solve, and the use of too many capacitors may increase the cost largely so that a limited application would be present.

Refer to FIG. 2, which is a block diagram of another conventional two-end driven lamp controlling device. As shown, the conventional two-end driven lamp controlling device 1 has a DC power supply 12 disposed on one side of a plurality of lamps 11, the DC power supply 12 is used for supplying DC power to a square wave switch 13, the square wave switch 13 is used for receiving synchronous control signals input from a square wave controller 14 and providing starting transformers 15 numerously corresponding to the lamps 11 with square wave signals and the starting transformers 15 are used for outputting signals such as to drive the lamps 11, so that the purpose for maintaining a homogenized brightness of the lamps 11 can be fulfilled. According to the block diagram shown in FIG. 2, there are starting transformers disposed at both ends of the lamp, which may keep the brightness from being inhomogeneous and solve the problem of voltage endurance. However, the use of so many starting transformers may increase the cost, so that a limited application would be present, also.

Therefore, the above-mentioned conventional techniques have still various shortcomings and, as it being not ideally designed, an improvement is in need. In view of this, the present inventor(s) has (have) set about the work of improvement and innovation and successfully developed the two-end driven lamp controlling device of the present invention through a long-term study and practice.

SUMMARY OF THE INVENTION

The primary objective of this invention is to provide a two-end driven lamp controlling device for balancing a plurality of lamps to fulfill the purpose for homogenizing the brightness of the lamps.

Another objective of this invention is to provide a two-end driven lamp controlling device that has advantages of increased stability of use, elongated lifetime of use, decreased cost, reduced size of transformers and saved space for set-up.

A two-end driven lamp controlling device for fulfilling the objectives of the present invention comprises a direct-current (DC) power supply, square wave switches, a square wave controller, a plurality of lamps, a plurality of starting transformers and a connecting transformer, wherein the plurality of starting transformers or the connecting transformer are disposed on the sides of the plurality of lamps and the square wave switches are connected to the sides of the plurality of starting transformers or the connecting transformer and to the DC power supply and can receive signals from the square wave controller. The present invention utilizes a circuitry design of a plurality of lamps, a plurality of starting transformers and a connecting transformer so as to make the brightness of the plurality of lamps effectively homogenized and balanced and, moreover, to solve the problem of high cost for conventional devices, which use too many components for maintaining the brightness of the lamps.

DESCRIPTION OF THE PREFERRED EMBODIMENT

Figure 1:
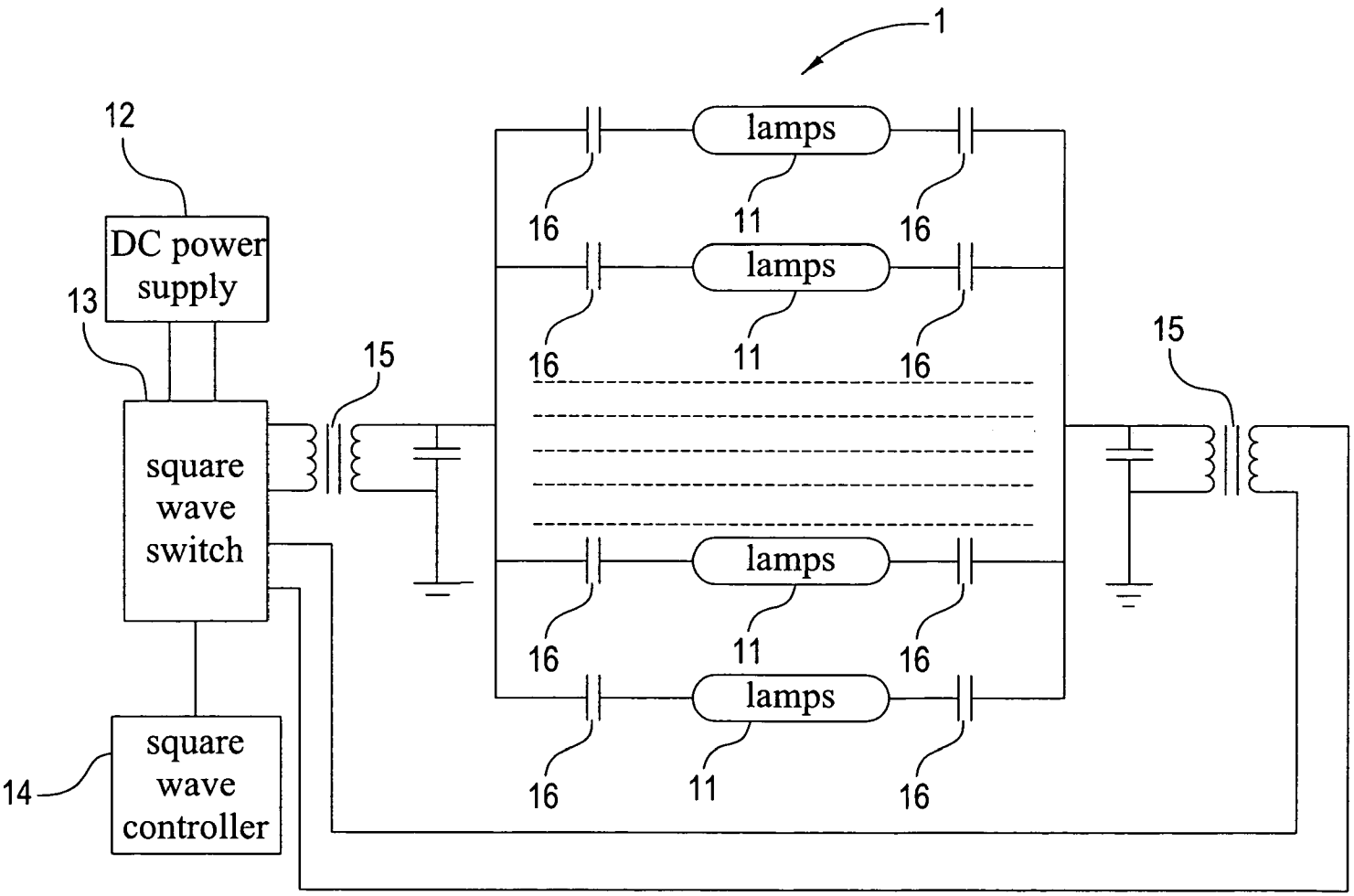
FIG. 1 PRIOR ART
FIG. 1 is a block diagram of a conventional two-end driven lamp controlling device.
Figure 2:
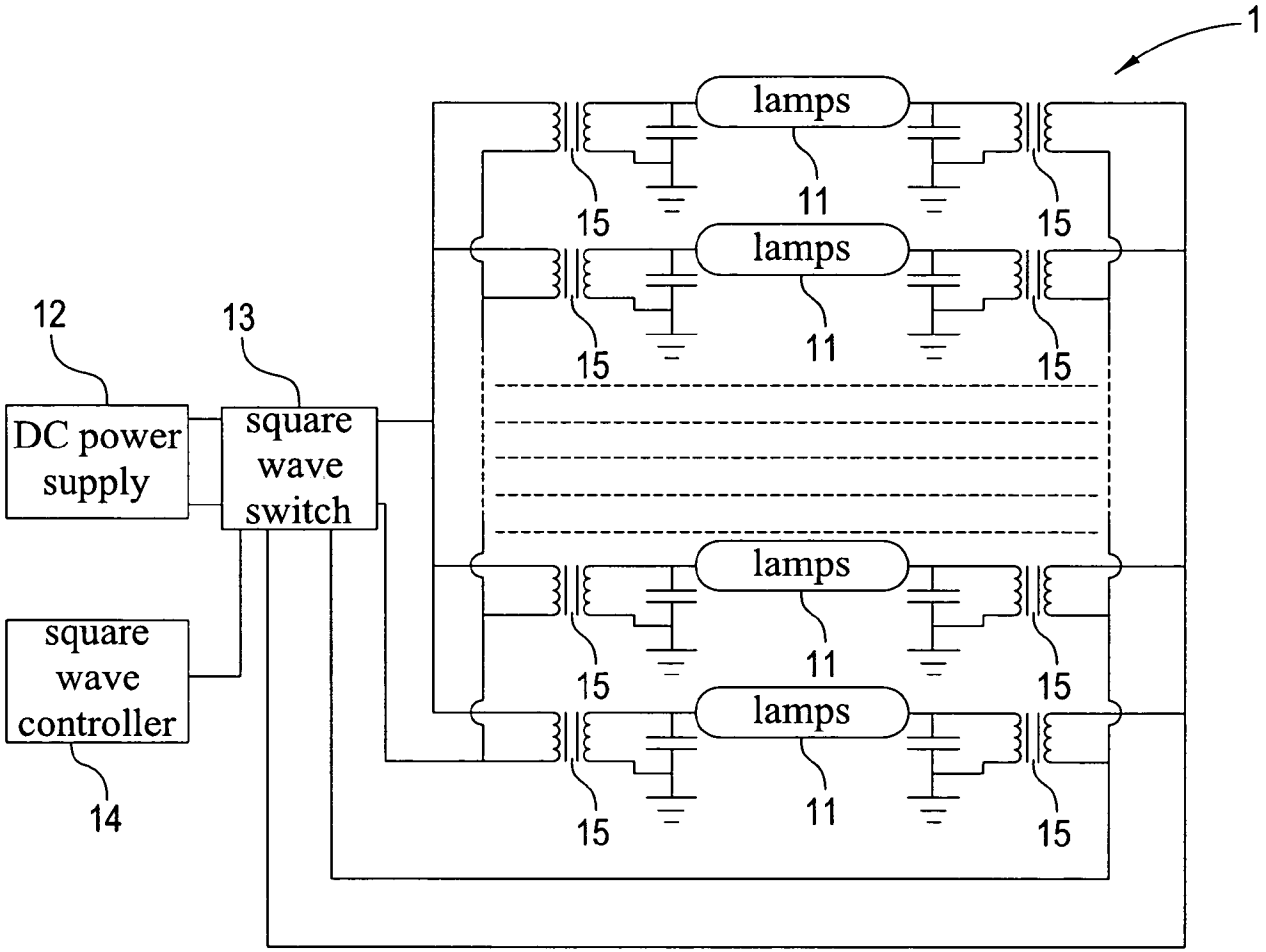
FIG.2 PRIOR ART
FIG. 2 is a block diagram of another conventional two-end driven lamp controlling device.
Figure 3:
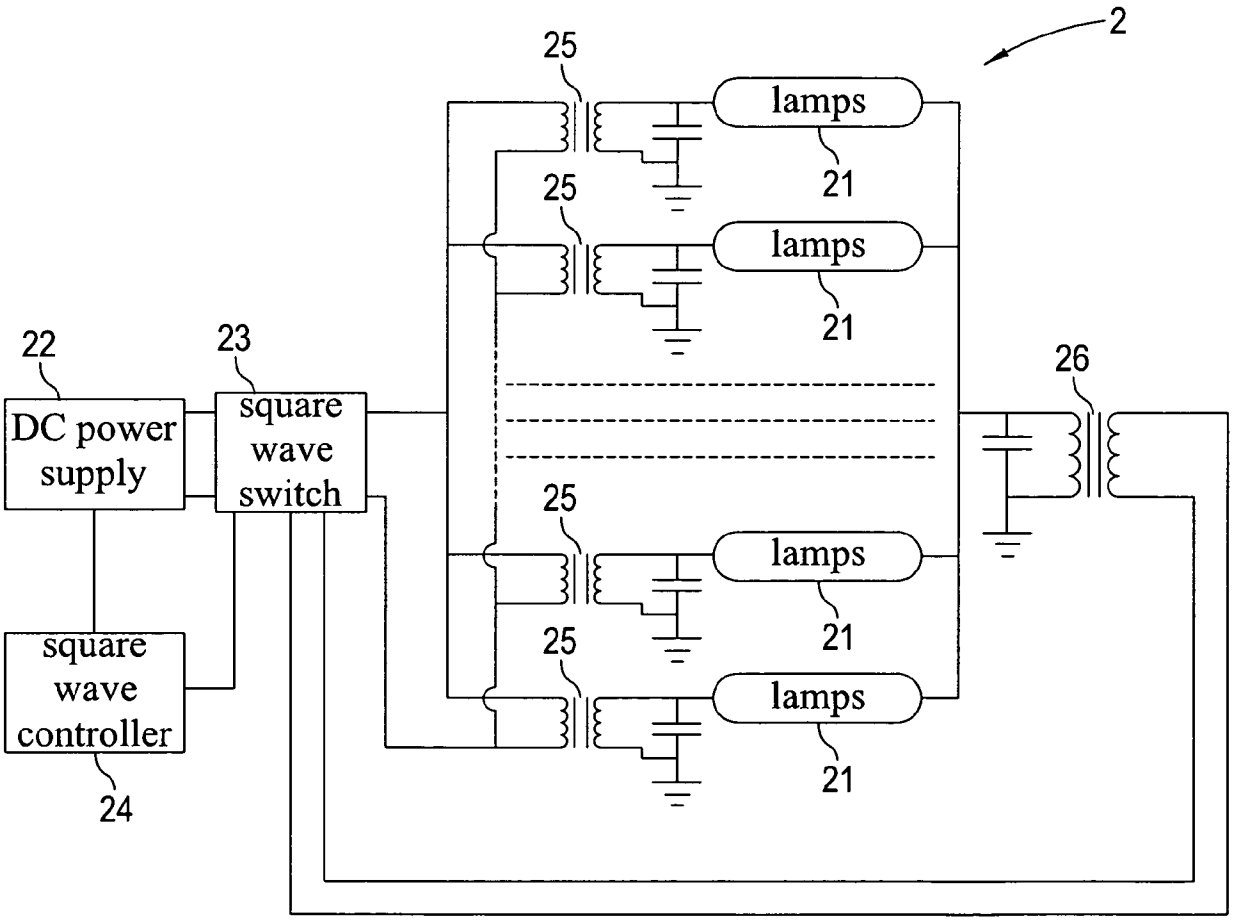
FIG. 3 is a circuit diagram of a first embodiment of the two-end driven lamp controlling device according to the present invention.

Refer to FIG. 3, which is a circuit diagram of a first embodiment of the two-end driven lamp controlling device according to the present invention. As shown, the conventional two-end driven lamp controlling device 2 comprises:

a DC power supply 22, for outputting DC power to a square wave switch 23;

a square wave switch 23, for receiving DC power from the DC power supply 22, converting the DC power into AC power and then outputting the AC power to a plurality of starting transformers 25 and a commonly connective transformer 26;

a square wave controller 24, for outputting control signals to the square wave switch 23;

a plurality of lamps 21, the lamp 21 having an independent end and a commonly connective end for which the voltage phases are reverse to each other, wherein the commonly connective ends of the lamps 21 are commonly connected to a point that is further connected to at least one set of secondary coil of the commonly connective transformer 26 while the independent end of the lamp 21 is connected to at least one set of secondary coil of a corresponding one of the plurality of starting transformers 25;

a plurality of starting transformers 25, the starting transformer 25 having at least one set of primary coil and at least one set of secondary coil, each set having two ends, wherein the at least one set of primary coil receives power signals from the square wave switch 23 while the at least one set of secondary coil, after voltage raising, has one end connected to the independent end of a corresponding one of the plurality of lamps 21 and the other one end connected to a reference ground level; and a commonly connective transformer 26, having at least one set of primary coil and at least one set of secondary coil, each set having two ends, wherein the at least one set of primary coil receives power signals from the square wave switch 23 while the at least one set of secondary coil, after voltage raising, has one end connected to the commonly connective ends of the plurality of lamps 21 and the other one end connected to a reference ground level.

Thus, the problem of high cost for conventional devices can be solved effectively.

Figure 4:
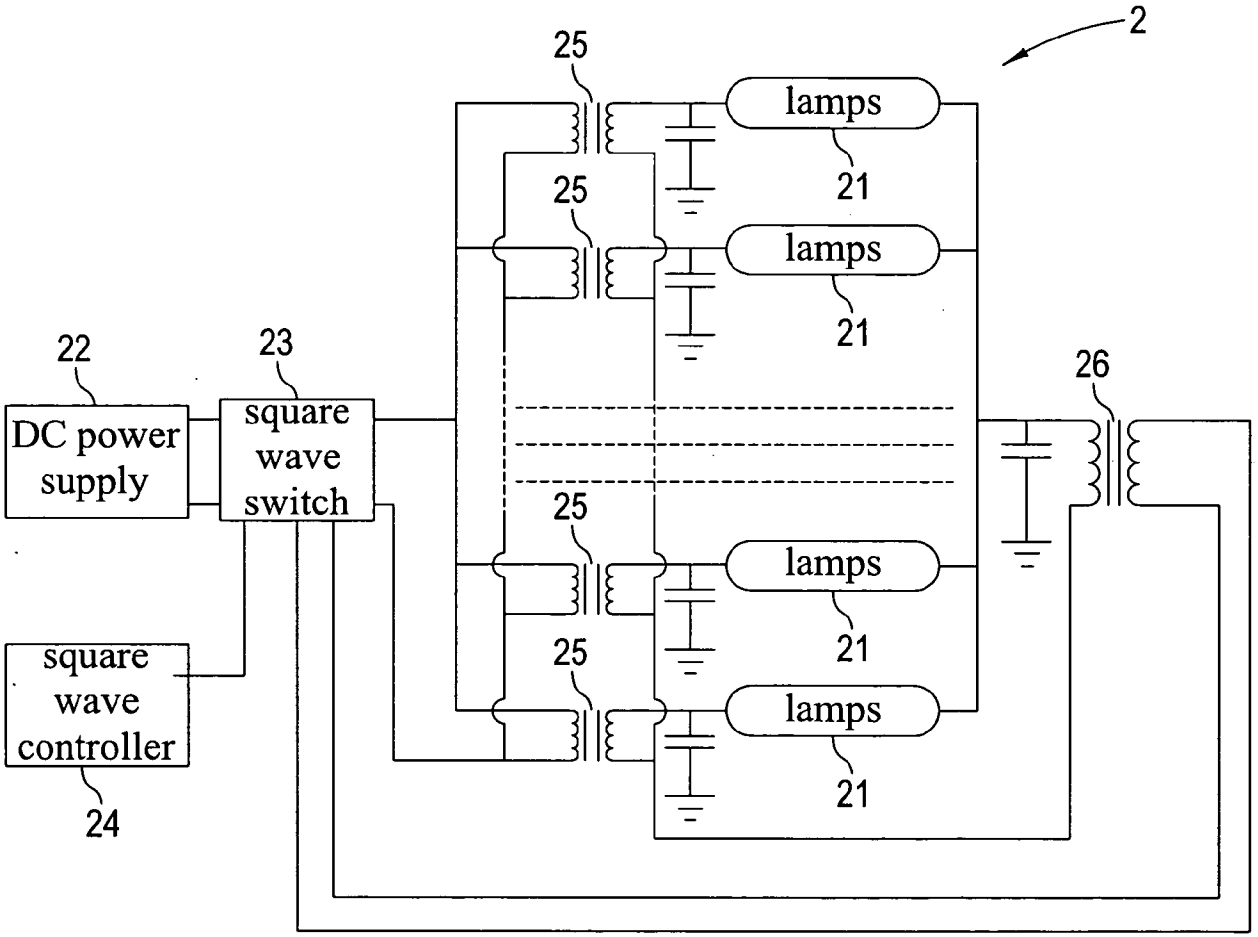
FIG. 4 is a circuit diagram of a second embodiment of the two-end driven lamp controlling device according to the present invention.

Refer to FIG. 4, which is a circuit diagram of a second embodiment of the two-end driven lamp controlling device according to the present invention. As shown, the conventional two-end driven lamp controlling device 2 comprises:

a DC power supply 22, for outputting DC power to a square wave switch 23;

a square wave switch 23, for receiving DC power from the DC power supply 22, converting the DC power into AC power and then outputting the AC power to a plurality of starting transformers 25 and a commonly connective transformer 26;

a square wave controller 24, for outputting control signals to the square wave switch 23;

a plurality of lamps 21, the lamp 21 having an independent end and a commonly connective end for which the voltage phases are reverse to each other, wherein the commonly connective ends of the lamps 21 are commonly connected to a point that is further connected to at least one set of secondary coil of the commonly connective transformer 26 while the independent end of the lamp 21 is connected to at least one set of secondary coil of a corresponding one of the plurality of starting transformers 25;

a plurality of starting transformers 25, the starting transformer 25 having at least one set of primary coil and at least one set of secondary coil, each set having two ends, wherein the at least one set of primary coil receives power signals from the square wave switch 23 while the at least one set of secondary coil, after voltage raising, has one end connected to the independent end of a corresponding one of the plurality of lamps 21 and the other one end connected to one end of the at least one set of secondary coil of the connecting transformer 26 so as to form a serial loop; and a commonly connective transformer 26, having at least one set of primary coil and at least one set of secondary coil, each set having two ends, wherein the at least one set of primary coil receives power signals from the square wave switch 23 while the at least one set of secondary coil, after voltage raising, has one end connected to the commonly connective ends of the plurality of lamps 21 and the other one end connected to the one ends of the at least one sets of secondary coil of the starting transformers 25 so as to form a serial loop.

Thus, the problem of high cost for conventional devices can be solved effectively.

Figure 5:
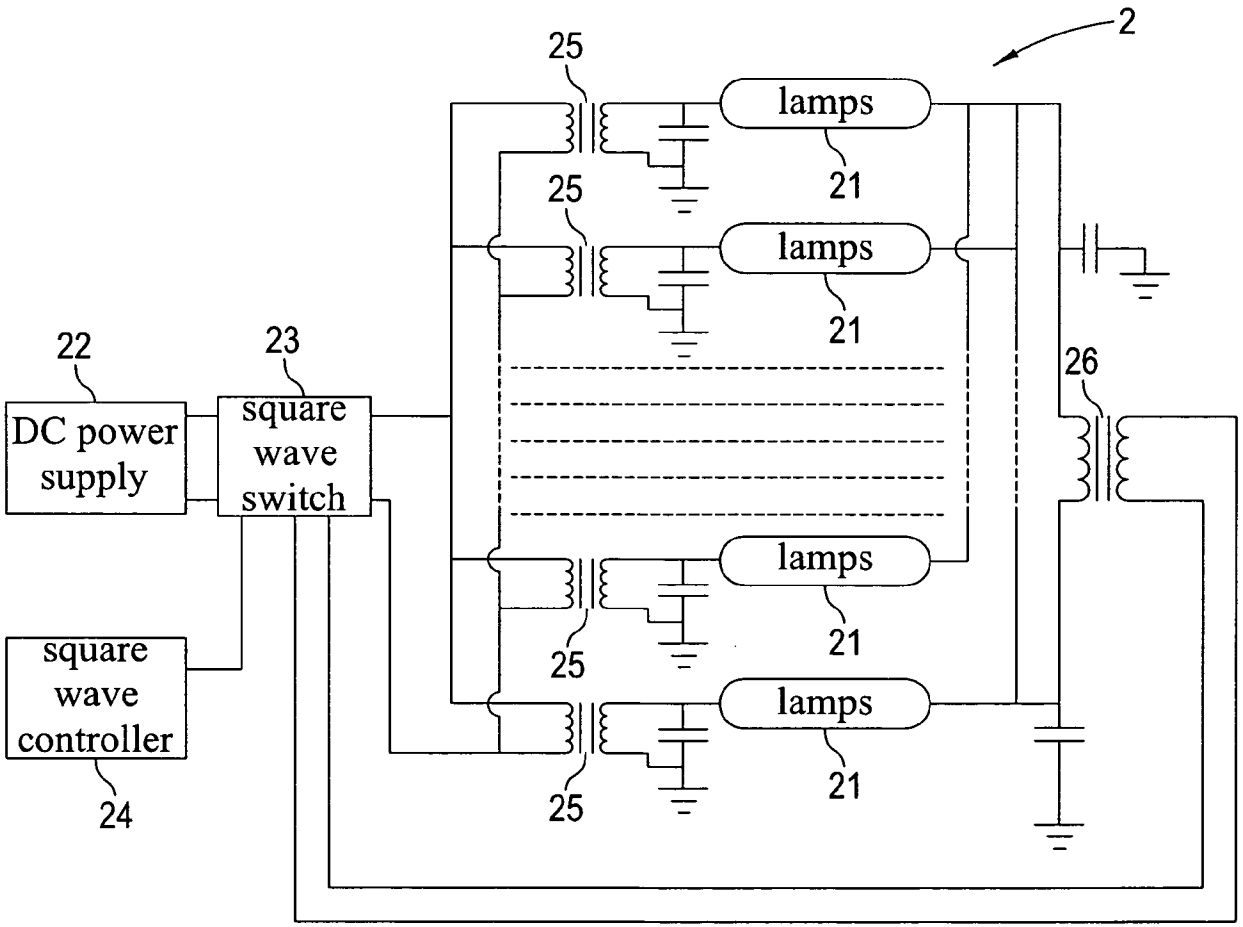
FIG. 5 is a circuit diagram of a third embodiment of the two-end driven lamp controlling device according to the present invention.

Refer to FIG. 5, which is a circuit diagram of a third embodiment of the two-end driven lamp controlling device according to the present invention. As shown, the conventional two-end driven lamp controlling device 2 comprises:

a DC power supply 22, for outputting DC power to a square wave switch 23;

a square wave switch 23, for receiving DC power from the DC power supply 22, converting the DC power into AC power and then outputting the AC power to a plurality of starting transformers 25 and a commonly connective transformer 26;

a square wave controller 24, for outputting control signals to the square wave switch 23;

a plurality of lamps 21, the lamp 21 having an independent end and a commonly connective end for which the voltage phases are reverse to each other, wherein the commonly connective ends of the lamps 21 are commonly connected to a point that is further connected to at least one set of secondary coil of the commonly connective transformer 26 while the independent end of the lamp 21 is connected to at least one set of secondary coil of a corresponding one of the plurality of starting transformers 25;

a plurality of starting transformers 25, the starting transformer 25 having at least one set of primary coil and at least one set of secondary coil, each set having two ends, wherein the at least one set of primary coil receives power signals from the square wave switch 23 while the at least one set of secondary coil, after voltage raising, has one end connected to the independent end of a corresponding one of the plurality of lamps 21 and the other one end connected to a reference ground level; and a commonly connective transformer 26, having at least one set of primary coil and at least one set of secondary coil, each set having two ends, wherein the at least one set of primary coil receives power signals from the square wave switch 23 while the at least one set of secondary coil, after voltage raising, has one end connected to one set of commonly connective ends of the plurality of lamps 21 and the other one end connected to the other one sets of commonly connective end of the plurality of lamps 21.

Thus, the problem of high cost for conventional devices can be solved effectively.

Figure 6:
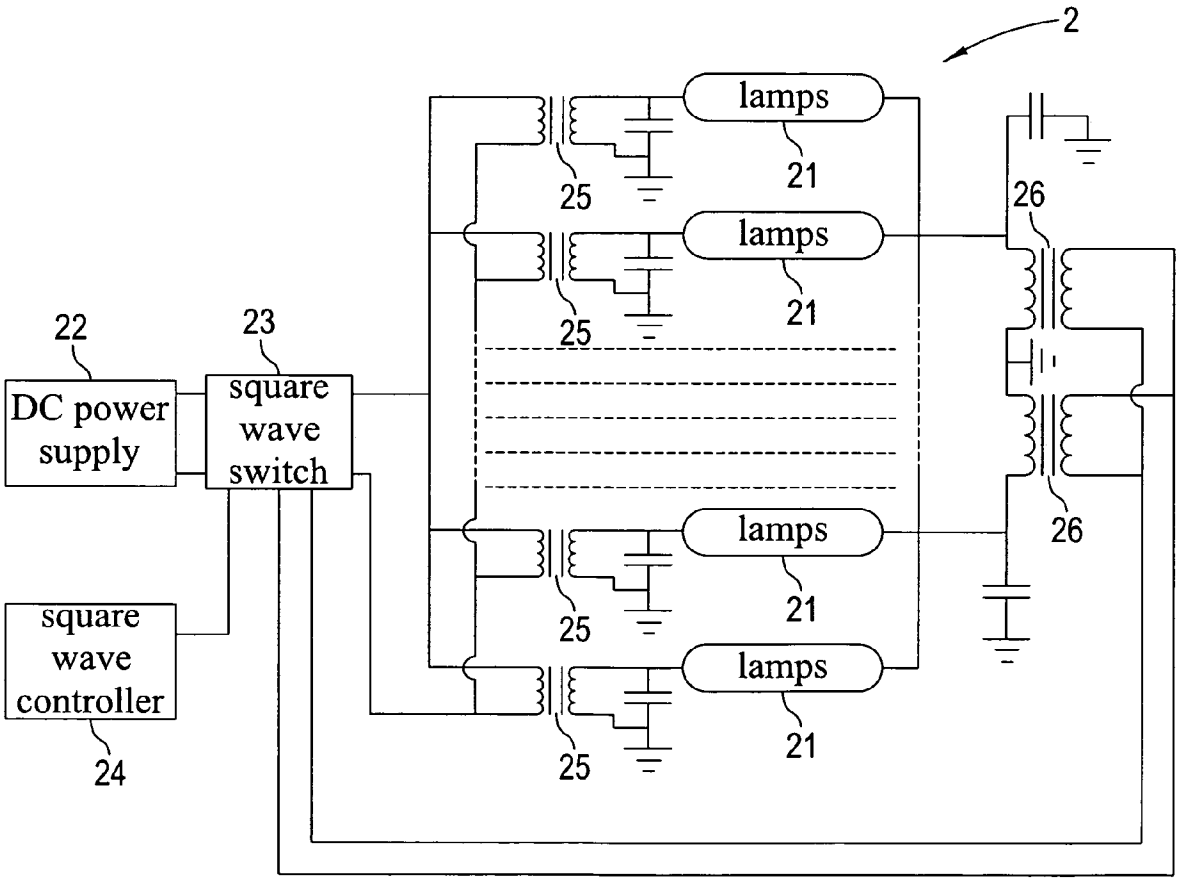
FIG. 6 is a circuit diagram of a forth embodiment of the two-end driven lamp controlling device according to the present invention.

Refer to FIG. 6, which is a circuit diagram of a forth embodiment of the two-end driven lamp controlling device according to the present invention. As shown, the conventional two-end driven lamp controlling device 2 comprises:

a DC power supply 22, for outputting DC power to a square wave switch 23;

a square wave switch 23, for receiving DC power from the DC power supply 22, converting the DC power into AC power and then outputting the AC power to a plurality of starting transformers 25 and two commonly connective transformers 26;

a square wave controller 24, for outputting control signals to the square wave switch 23;

a plurality of lamps 21, the lamp 21 having an independent end and a commonly connective end for which the voltage phases are reverse to each other, wherein the commonly connective ends of the lamps 21 are commonly connected to a point that is further connected to at least one set of secondary coil of the commonly connective transformer 26 while the independent end of the lamp 21 is connected to at least one set of secondary coil of a corresponding one of the plurality of starting transformers 25;

a plurality of starting transformers 25, the starting transformer 25 having at least one set of primary coil and at least one set of secondary coil, each set having two ends, wherein the at least one set of primary coil receives power signals from the square wave switch 23 while the at least one set of secondary coil, after voltage raising, has one end connected to the independent end of a corresponding one of the plurality of lamps 21 and the other one end connected to a reference ground level; and two commonly connective transformers 26, each having at least one set of primary coil and at least one set of secondary coil, each set having two ends, wherein the at least one set of primary coil receives power signals from the square wave switch 23 while the at least one set of secondary coil, after voltage raising, has one end connected to one end of the at least one set of secondary coil of the other one commonly connective transformer 26, both further connected to a reference ground level, and the other one end connected to one of two sets of commonly connective ends of the plurality of lamps 21 so as to decrease the power of a single one of the commonly connective transformers 26 to achieve alternative polarization of the lamps 21.

Thus, the problem of high cost for conventional devices can be solved effectively.

Figure 7:
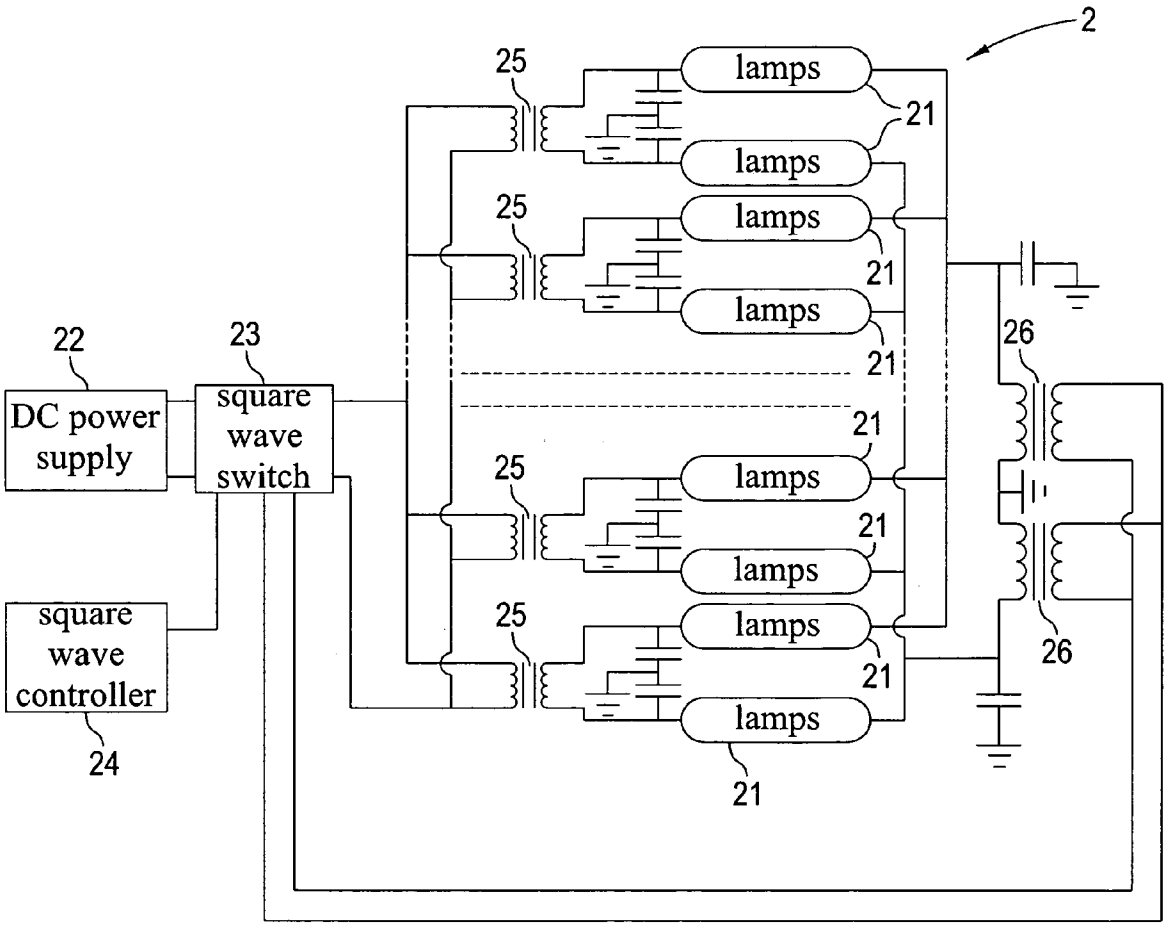
FIG. 7 is a circuit diagram of a sixth embodiment of the two-end driven lamp controlling device according to the present invention.

Refer to FIG. 7, which is a circuit diagram of a sixth embodiment of the two-end driven lamp controlling device according to the present invention. As shown, the conventional two-end driven lamp controlling device 2 comprises:

a DC power supply 22, for outputting DC power to a square wave switch 23;

a square wave switch 23, for receiving DC power from the DC power supply 22, converting the DC power into AC power and then outputting the AC power to a plurality of starting transformers 25 and two commonly connective transformers 26;

a square wave controller 24, for outputting control signals to the square wave switch 23;

a plurality of lamps 21, the lamp 21 having an independent end and a commonly connective end for which the voltage phases are reverse to each other, wherein the plurality of lamps 21 are divided into two sets of which one set has the commonly connective ends thereof commonly connected to a point that is further connected to one end of at least one set of secondary coil of the commonly connective transformer 26 and the other one set has the commonly connective ends thereof commonly connected to another point that is further connected to the other one end of the at least one set of secondary coil of the commonly connective transformer 26 while the independent end of the lamp 21 is connected to at least one set of secondary coil of a corresponding one of the plurality of starting transformers 25;

a plurality of starting transformers 25, the starting transformer 25 having at least one set of primary coil and at least one set of secondary coil, each set having two ends, wherein the at least one set of primary coil receives power signals from the square wave switch 23 while the at least one set of secondary coil, after voltage raising, has one end connected to the independent end of a corresponding one of the plurality of lamps 21 and the other one end connected to the independent end of another corresponding one of the plurality of lamps 21; and two commonly connective transformers 26, each having at least one set of primary coil and at least one set of secondary coil, each set having two ends, wherein the at least one set of primary coil receives power signals from the square wave switch 23 while the at least one set of secondary coil, after voltage raising, has one end connected to one end of the at least one set of secondary coil of the other one commonly connective transformer 26, both further connected to a reference ground level, and the other one end connected to one of two sets of commonly connective ends of the plurality of lamps 21 so as to decrease the power of a single one of the commonly connective transformers 26 to achieve alternative polarization of the lamps 21.

Thus, the problem of high cost for conventional devices can be solved effectively.

Figure 8A:
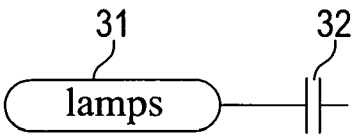
FIG. 8A-8E are schematic diagrams of the lamp impedance matching of the two-end driven lamp controlling device according to the present invention.
Figure 8B:
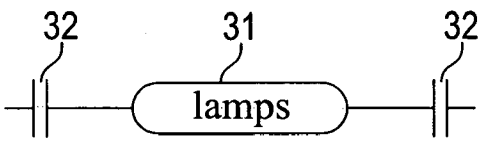
Figure 8C:
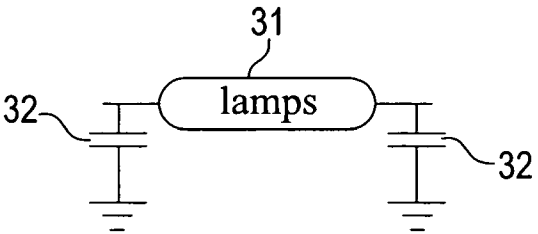
Figure 8D:
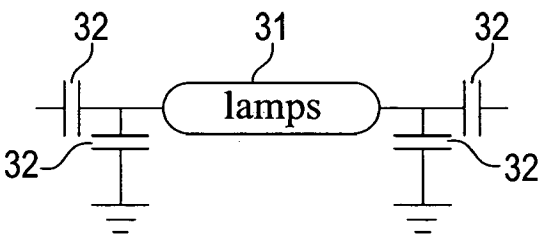
Figure 8E:
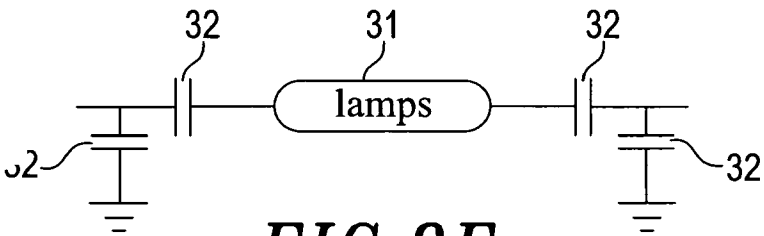

Refer to FIG. 8A-8E, which are schematic diagrams of the lamp impedance matching of the two-end driven lamp controlling device according to the present invention. As shown, for the two-end driven lamp controlling device, to one end of a lamp 31, a capacitive element 32 can be connected in series, which can be further connected to another electronic element (FIG. 8A); to each of the two ends of a lamp 31, a capacitive element 32 can be connected in series, which can be further connected to other electronic elements (FIG. 8B); to each of the two ends of a lamp 31, a capacitive element 32 can be connected in series, which can be further connected to reference ground levels (FIG. 8C); to each of the two ends of a lamp 31, two capacitive elements 32 can be connected in parallel, which can be further connected to other electronic elements or reference ground levels, respectively (FIG. 8D); to each of the two ends of a lamp 31, two capacitive elements 32 can be connected in series, which can be further connected to reference ground levels (FIG. 8E). Impedance matching can be achieved, thus.

The present invention provides a two-end driven lamp controlling device, as compared with conventional techniques, having the following advantages:

1. The two-end driven lamp controlling device can make the brightness of a plurality of lamps effectively homogenized and balanced.

2. The two-end driven lamp controlling device has advantages of increased stability of use, elongated lifetime of use, decreased cost, reduced size of transformers and saved space for set-up.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A two-end driven lamp controlling device comprising:

a DC power supply, for outputting DC power to a square wave switch;

the square wave switch, for receiving the DC power from the DC power supply, converting the DC power into AC power and then outputting the AC power to a plurality of starting transformers and a commonly connective transformer;

a square wave controller, for outputting control signals to the square wave switch;

a plurality of lamps, each lamp having an independent end and a commonly connective end for which voltage phases are reverse to each other, wherein the commonly connective ends of the lamps are commonly connected to a point that is further connected to at least one set of secondary coil of the commonly connective transformer while the independent ends of the lamps are connected to at least one set of secondary coil of a corresponding one of the plurality of starting transformers;

each starting transformer, having at least one set of primary coil and the at least one set of secondary coil, each set having two ends, wherein the at least one set of primary coil receives power signals from the square wave switch while the at least one set of secondary coil, after voltage raising, has one end connected to the independent end of the corresponding one of the plurality of lamps and the other one end connected to a reference ground level; and the commonly connective transformer, having at least one set of primary coil and the at least one set of secondary coil, each set having two ends, wherein the at least one set of primary coil receives power signals from the square wave switch while the at least one set of secondary coil, after voltage raising, has one end connected to the point that is further connected the commonly connective ends of the plurality of lamps and the other one end connected to a reference ground level.

2. A two-end driven lamp controlling device comprising:

a DC power supply, for outputting DC power to a square wave switch;

the square wave switch, for receiving DC power from the DC power supply, converting the DC power into AC power and then outputting the AC power to a plurality of starting transformers and a commonly connective transformer;

a square wave controller, for outputting control signals to the square wave switch;

a plurality of lamps, each lamp having an independent end and a commonly connective end for which voltage phases are reverse to each other, wherein the commonly connective ends of the lamps are commonly connected to a point that is further connected to at least one set of secondary coil of the commonly connective transformer while the independent ends of the lamps are connected to at least one set of secondary coil of a corresponding one of the plurality of starting transformers;

each starting transformer, having at least one set of primary coil and the at least one set of secondary coil, each set having two ends, wherein the at least one set of primary coil receives power signals from the square wave switch while the at least one set of secondary coil, after voltage raising, has one end connected to the independent end of the corresponding one of the plurality of lamps and the other one end connected to one end of the at least one set of secondary coil of the connecting transformer so as to form a serial loop; and the commonly connective transformer, having at least one set of primary coil and the at least one set of secondary coil, each set having two ends, wherein the at least one set of primary coil receives power signals from the square wave switch while the at least one set of secondary coil, after voltage raising, has one end connected to the point that is further connected the commonly connective ends of the plurality of lamps and the other one end connected to the one ends of the at least one sets of secondary coil of the starting transformers so as to form a serial loop.

3. A two-end driven lamp controlling device comprising:

a DC power supply, for outputting DC power to a square wave switch;

a square wave switch, for receiving DC power from the DC power supply, converting the DC power into AC power and then outputting the AC power to a plurality of starting transformers and a commonly connective transformer;

a square wave controller, for outputting control signals to the square wave switch;

a plurality of lamps, each lamp having an independent end and a commonly connective end for which the voltage phases are reverse to each other, wherein the commonly connective ends of the lamps are commonly connected to a point that is further connected to at least one set of secondary coil of the commonly connective transformer while the independent ends of the lamps are connected to at least one set of secondary coil of a corresponding one of the plurality of starting transformers;

each starting transformer having at least one set of primary coil and the at least one set of secondary coil, each set having two ends, wherein the at least one set of primary coil receives power signals from the square wave switch while the at least one set of secondary coil, after voltage raising, has one end connected to the independent end of a corresponding one of the plurality of lamps and the other one end connected to a reference ground level; and the commonly connective transformer, having at least one set of primary coil and at least one set of secondary coil, each set having two ends, wherein the at least one set of primary coil receives power signals from the square wave switch while the at least one set of secondary coil, after voltage raising, has one end connected to one set of commonly connective ends of the plurality of lamps and the other one end connected to the other one sets of commonly connective end of the plurality of lamps.

4. A two-end driven lamp controlling device comprising:

a DC power supply, for outputting DC power to a square wave switch;

the square wave switch, for receiving the DC power from the DC power supply, converting the DC power into AC power and then outputting the AC power to a plurality of starting transformers and two commonly connective transformers;

a square wave controller, for outputting control signals to the square wave switch;

a plurality of lamps, each lamp having an independent end and a commonly connective end for which the voltage phases are reverse to each other, wherein the commonly connective ends of the lamps are commonly connected to a point that is further connected to at least one set of secondary coil of the commonly connective transformer while the independent ends of the lamps are connected to at least one set of secondary coil of a corresponding one of the plurality of starting transformers;

each starting transformer, having at least one set of primary coil and the at least one set of secondary coil, each set having two ends, wherein the at least one set of primary coil receives power signals from the square wave switch while the at least one set of secondary coil, after voltage raising, has one end connected to the independent end of a corresponding one of the plurality of lamps and the other one end connected to a reference ground level; and the commonly connective transformer, having at least one set of primary coil and the at least one set of secondary coil, each set having two ends, wherein the at least one set of primary coil receives power signals from the square wave switch while the at least one set of secondary coil, after voltage raising, has one end connected to one end of the at least one set of secondary coil of the other one commonly connective transformer, both further connected to a reference ground level, and the other one end connected to one of two sets of commonly connective ends of the plurality of lamps so as to decrease the power of a single one of the commonly connective transformers to achieve alternative polarization of the lamps.

5. A two-end driven lamp controlling device comprising:

a DC power supply, for outputting DC power to a square wave switch;

the square wave switch, for receiving the DC power from the DC power supply, converting the DC power into AC power and then outputting the AC power to a plurality of starting transformers and two commonly connective transformers;

a square wave controller, for outputting control signals to the square wave switch;

a plurality of lamps, each lamp having an independent end and a commonly connective end and voltage phases of two ends being reverse to each other, wherein the plurality of lamps are divided into two sets of which one set has the commonly connective ends commonly connected to a point that is further connected to one end of at least one set of secondary coil of the commonly connective transformer and the other one set has the commonly connective ends commonly connected to another point that is further connected to the other one end of the at least one set of secondary coil of the commonly connective transformer while the independent end of the lamp is connected to at least one set of secondary coil of the corresponding one of the plurality of starting transformers;

each starting transformer having at least one set of primary coil and at least one set of secondary coil, each set having two ends, wherein the at least one set of primary coil receives power signals from the square wave switch while the at least one set of secondary coil, after voltage raising, has one end connected to the independent end of a corresponding one of the plurality of lamps and the other one end connected to the independent end of another corresponding one of the plurality of lamps; and each commonly connective transformer, having at least one set of primary coil and at least one set of secondary coil, each set having two ends, wherein the at least one set of primary coil receives power signals from the square wave switch while the at least one set of secondary coil, after voltage raising, has one end connected to one end of the at least one set of secondary coil of the other one commonly connective transformer, both further connected to a reference ground level, and the other one end connected to one of two sets of commonly connective ends of the plurality of lamps so as to decrease the power of a single one of the commonly connective transformers to achieve alternative polarization of the lamps.

* * * * *